US005828303A

United States Patent [19]

Williams

[11] Patent Number: 5,828,303

[45] Date of Patent: Oct. 27, 1998

[54] APPARATUS FOR FACILITATING INSTRUCTION OF ELECTRONIC SECURITY AND ELECTRONIC ACCESS CONTROL

[76] Inventor: Harold J. Williams, 7420 Thompson Rd., Indianapolis, Ind. 46237

[21] Appl. No.: 955,038

[22] Filed: Oct. 21, 1997

[51] Int. Cl.[6] ..... G08B 13/08

[52] U.S. Cl. ..... 340/545; 340/541; 340/549

[58] Field of Search ..... 340/541, 545, 340/549, 691, 825.3, 825.31, 825.34, 528; 49/68, 70; 439/536, 540.1, 544

[56] References Cited

U.S. PATENT DOCUMENTS

| | | | |
|---|---|---|---|
| 4,146,293 | 3/1979 | Mutton et al. | 340/545 |
| 4,394,584 | 7/1983 | Spahni et al. | 307/117 |
| 4,671,582 | 6/1987 | Steomquist et al. | 439/31 |
| 4,754,263 | 6/1988 | Trimble | 340/545 |
| 4,763,937 | 8/1988 | Sittnick et al. | 340/542 |
| 4,968,610 | 11/1990 | Dietrich | 340/541 |
| 5,479,151 | 12/1995 | Lavelle et al. | 340/545 |
| 5,694,867 | 12/1997 | Diaz-Lapez | 49/68 |
| 5,749,253 | 5/1998 | Glick et al. | 70/278 |

*Primary Examiner*—Brent A. Swarthout
*Assistant Examiner*—Van Trieu
*Attorney, Agent, or Firm*—Woodard, Emhardt, Naughton, Moriarty & McNett

[57] ABSTRACT

An apparatus is disclosed for facilitating instruction of electronic security and electronic access control, wherein the apparatus of the present invention may be used to provide instruction in electrical circuit theory as well as practical design, installation, and troubleshooting of electronic security and electronic access control systems. All of the devices necessary to construct, such circuits are mounted in close physical proximity to each other upon an installation mock-up frame and may be used in conjunction with a working model of a hinged door mounted to such frame. Furthermore, most or all of the devices are connected to a system of terminal blocks which greatly facilitates interconnection of the devices into an electronic circuit without blocking the space required to open the door. Finally, the apparatus includes an integral power supply for providing power to the electronic circuit thus assembled.

20 Claims, 7 Drawing Sheets

TOP TERMINAL BLOCK

BOTTOM TERMINAL BLOCK

APPARATUS FOR FACILITATING INSTRUCTION OF ELECTRONIC SECURITY AND ELECTRONIC ACCESS CONTROL

TECHNICAL FIELD OF TEE INVENTION

The present invention generally relates to teaching aids and, more particularly, to an apparatus for facilitating instruction of electronic security and electronic access control.

BACKGROUND OF THE INVENTION

In the field of physical security, the use of keyed and combination locks to prevent or limit access to various spaces is old and well known. More recently, the fields of electronic security and electronic access control have developed, in which electronic and/or electromechanical devices are employed to monitor secure spaces, such as by electronic alarms, cameras, etc. (electronic security) and to provide electronically controlled means for preventing or limiting access to a particular area, such as by remote or electronically actuated locking and unlocking door systems, etc. (electronic access control).

In today's electronic security and electronic access control fields, there is a wide range of state-of-the-art electronic security technologies in use. The proper specification, installation and maintenance of such devices requires an intimate knowledge of the devices themselves, as well as basic electronic circuit fundamentals. The traditional apprenticeship training techniques, in which an inexperienced trainee travels from jobsite to jobsite with an experienced locksmith-trainer, observing the trainer and learning the trade thereby, is inadequate for learning electronic security and electronic access control. This is due not only to the requirement for an understanding of the electronic principals underlying these fields, but also due to the very large number of combinations in which such devices may be connected. The manner in which such electronic devices are interconnected with one another can have a large impact on their operation.

There is therefore a need for an apparatus for facilitating classroom instruction of electronic security and electronic access control in a laboratory setting, such that the apparatus may be used to provide instruction in electrical circuit theory as well as practical design, installation and troubleshooting of electronic security and electronic access control systems. The present invention is directed towards meeting this need.

SUMMARY OF THE INVENTION

An apparatus is disclosed for facilitating instruction of electronic security and electronic access control, wherein the apparatus of the present invention may be used to provide instruction in electrical circuit theory as well as practical design, installation, and troubleshooting of electronic security and electronic access control systems. All of the devices necessary to construct such circuits are mounted in close physical proximity to each other upon an installation mock-up frame and may be used in conjunction with a working model of a hinged door mounted to such frame. Furthermore, most or all of the devices are connected to a system of terminal blocks which greatly facilitates interconnection of the devices into an electronic circuit without blocking the space required to open the door. Finally, the apparatus includes an integral power supply for providing power to the electronic circuit thus assembled.

In one form of the invention, an apparatus for facilitating instruction of electronic security and electronic access control is disclosed, comprising an installation mock-up frame having a cavity therein; a door hingedly attached to the installation mock-up frame, such that the door has an open position and a closed position in which access to the cavity is prevented by the door; a lockset installed into the door; an electric strike installed into the installation mock-up frame and positioned so as to interact with the lockset; a magnetic lock having first and second halves, the first half being coupled to the installation mock-up frame within the cavity and the second half being coupled to the door, wherein energization of the magnetic lock prevents the first and second halves from being separated, thus preventing the door from being opened; a roller switch coupled to the installation mock-up frame and operative to sense whether the door is open or closed; a plurality of electronic access control devices mounted to the installation mock-up frame above the door; a top terminal strip mounted to the installation mock-up frame above the door, wherein the plurality of electronic access control devices are electrically coupled to the top terminal strip; a bottom terminal strip mounted to the installation mock-up frame below the door; a power supply mounted to the installation mock-up frame and coupled to the bottom terminal strip; and a multiconductor wire coupling the top terminal strip to the bottom terminal strip, such that power is provided to the top terminal strip and such that the plurality of electronic access control devices are electrically coupled to the bottom terminal strip; wherein the installation mock-up frame is sized to be placed upon a laboratory bench; and wherein the plurality of electronic access control devices may be interconnected using the bottom and top terminal strips without placing wires across the door, thereby ensuring an unobstructed pathway for moving the door between the closed position and the open position.

In another form of the invention an apparatus for facilitating instruction of electronic security and electronic access control is disclosed, comprising an installation mock-up frame having a cavity therein; a door hingedly attached to the installation mock-up frame, such that the door has an open position and a closed position in which access to the cavity is prevented by the door; a lockset installed into the door; an electric strike installed into the installation mock-up frame and positioned so as to interact with the lockset; a plurality of electronic access control devices mounted to the installation mock-up frame above the door; a top terminal strip mounted to the installation mock-up frame above the door, wherein the plurality of electronic access control devices are electrically coupled to the top terminal strip; a bottom terminal strip mounted to the installation mock-up frame below the door; a power supply mounted to the installation mock-up frame and coupled to the bottom terminal strip; and a multiconductor wire coupling the top terminal strip to the bottom terminal strip, such that power is provided to the top terminal strip and such that the plurality of electronic access control devices are electrically coupled to the bottom terminal strip; wherein the installation mock-up frame is sized to be placed upon a laboratory bench; and wherein the plurality of electronic access control devices may be interconnected using the bottom and top terminal strips without placing wires across the door, thereby ensuring an unobstructed pathway for moving the door between the closed position and the open position.

In another form of the invention an apparatus for facilitating instruction of electronic security and electronic access control is disclosed, comprising an installation mock-up frame having a cavity therein; a door hingedly attached to the installation mock-up frame, such that the door has an open position and a closed position in which access to the cavity is prevented by the door; a lockset installed into the door; an electric strike installed into the installation mock-up frame and positioned so as to interact with the lockset; a plurality of electronic access control devices mounted to the installation mock-up frame above the door; a top terminal strip mounted to the installation mock-up frame above the door, wherein the plurality of electronic access control devices are electrically coupled to the top terminal strip; a bottom terminal strip mounted to the installation mock-up frame below the door; a multiconductor wire coupling the top terminal strip to the bottom terminal strip, such that the plurality of electronic access control devices are electrically coupled to the bottom terminal strip; wherein the installation mock-up frame is sized to be placed upon a laboratory bench; and wherein the plurality of electronic access control devices may be interconnected using the bottom and top terminal strips without placing wires across the door, thereby ensuring an unobstructed pathway for moving the door between the closed position and the open position.

DESCRIPTION OF THE PREFERRED EMBODIMENT

Figure 1:
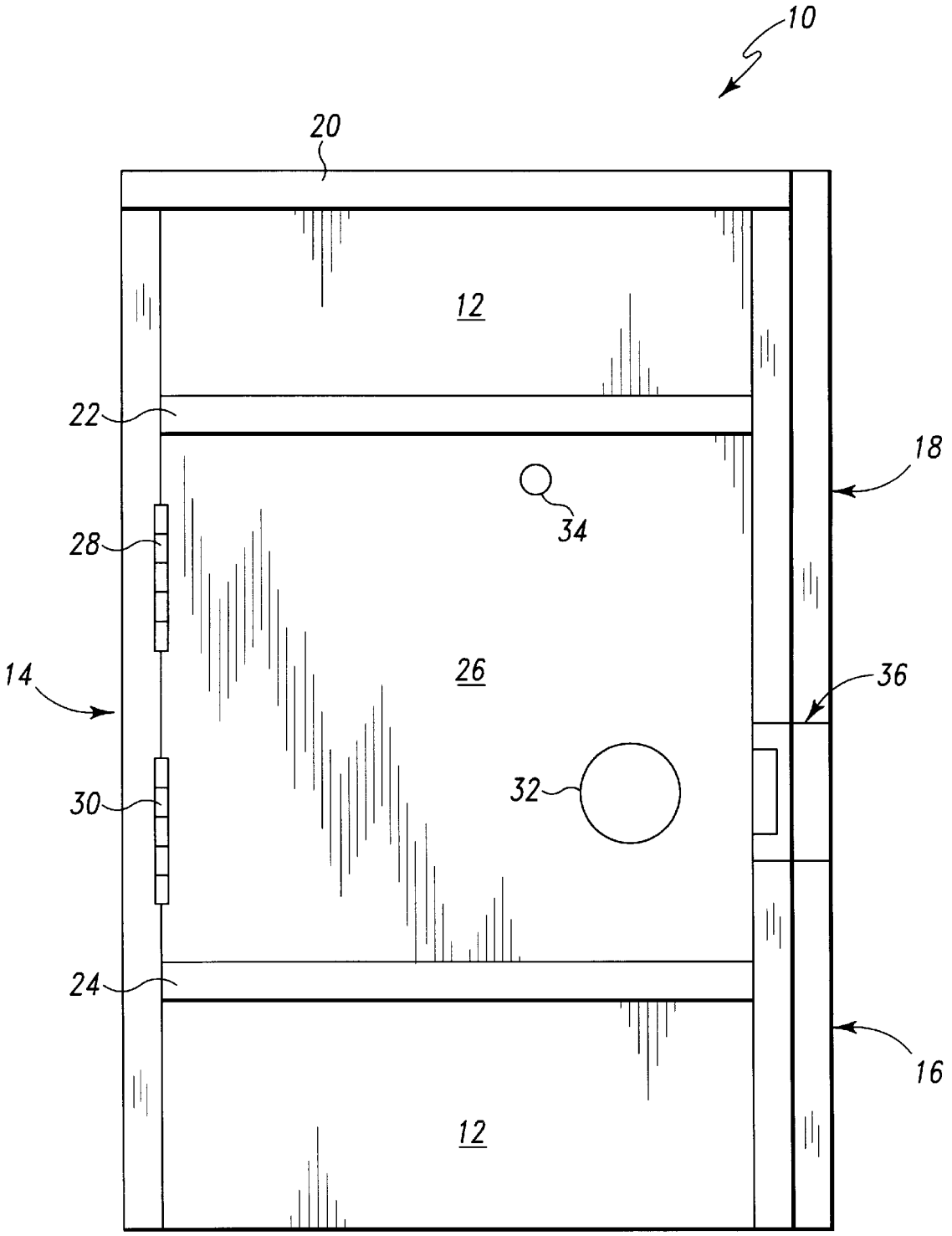
FIG. 1 is a top plan view of an installation mock-up frame used to construct the apparatus of the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

The present invention provides an apparatus for facilitating instruction of electronic security and electronic access control by providing a device of manageable size which includes various devices used in these fields and convenient means for wiring these devices into various circuit combinations. With reference to FIG. 1, there is illustrated an installation mock-up frame used to construct the apparatus of the present invention, indicated generally at 10. In a preferred embodiment, the installation mock-up frame 10 comprises a baseplate 12 which preferably covers the entire backside of the frame 10. The baseplate 12 preferably measures approximately 15 inches by 22 inches and, like the other portions of the installation mock-up frame 10, is preferably made of wood. A left side panel 14 is coupled to the baseplate 12 along the left side edge thereof, the left side panel 14 extending perpendicular to the baseplate 12 to a height of approximately four inches. Two light side panels 16 and 18 are similarly coupled to the right side edge of the baseplate 12. Alternatively, a single right side panel having a double thickness (not shown) could be mounted at this location. A top panel 20 is mounted along the upper edge of the baseplate 12, the top panel 20 also preferably extending approximately four inches from the baseplate 12. An upper cross brace 22 and a lower cross brace 24 are mounted to the baseplate 12 and extend between the left side panel 14 and the right side panel 18.

Thusly constructed, the left side panel 14, upper cross brace 22, right side panel 18, and lower cross brace 24 define a cavity near the center of the installation mock-up frame 10. In order to close this cavity, a door 26 is mounted therein upon a pair of hinges 28 and 30 mounted to the left side panel 14 and to the door 26. The door 26 is preferably approximately one foot square and formed to the same thickness as a standard entryway door. The door 26 has a first hole 32 drilled therethrough in order to allow installation of a door handle and lockset (see FIG. 2) and a second hole 34 drilled therethrough in order to allow installation of a magnetic lock (see FIG. 2). Furthermore, a cutout 36 is formed into the right side panels 16 and 18 in order to mount an electric strike therein (see FIG. 2).

Figure 2:
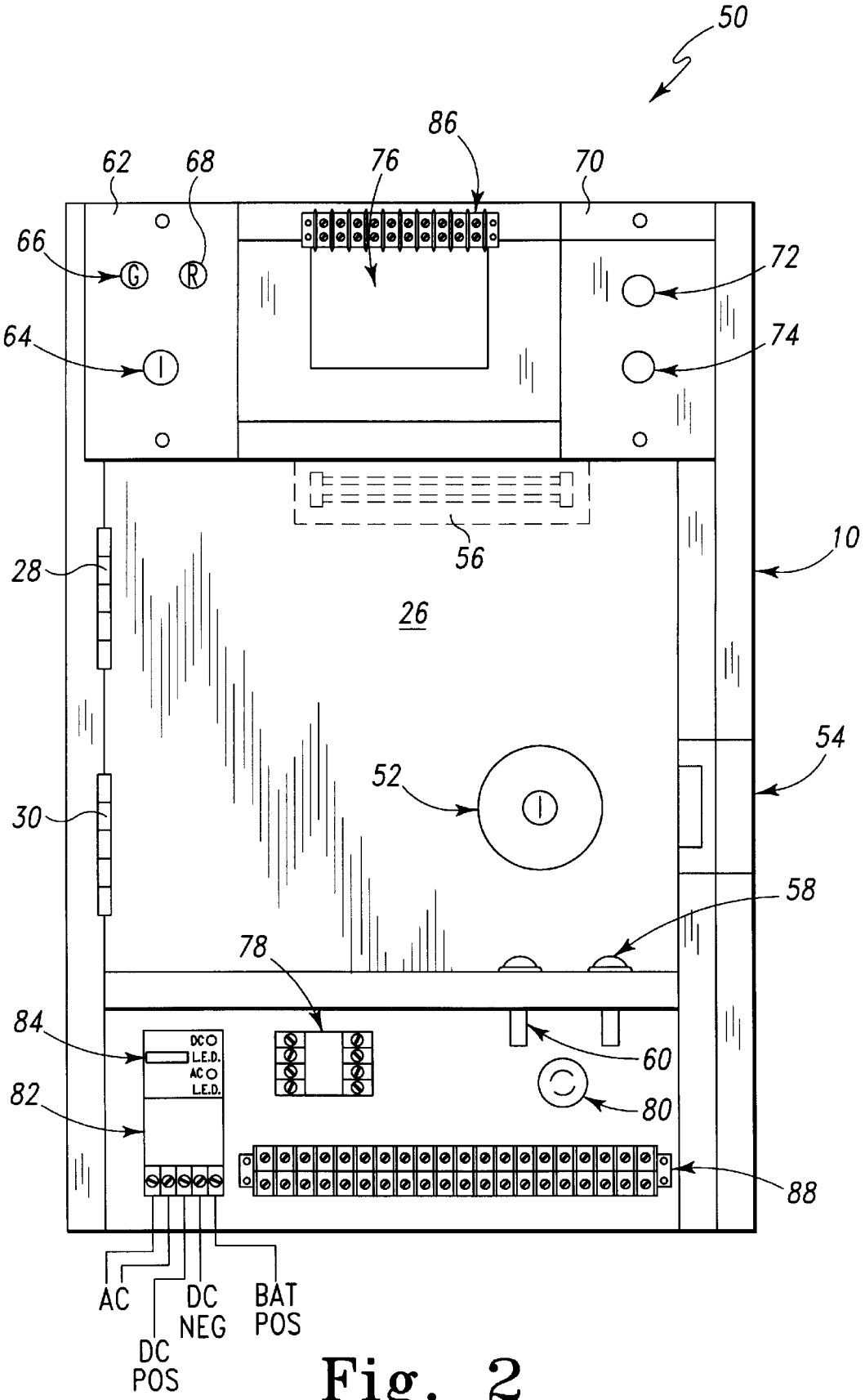
FIG. 2 is a top plan view of a preferred embodiment apparatus of the present invention.

Referring now to FIG. 2, various devices used in the fields of electronic security and electronic access control are mounted to the installation mock-up frame 10, along with means for powering these devices and for interconnecting these devices into an electronic circuit. A preferred embodiment of the apparatus of the present invention is illustrated in FIG. 2 and indicated generally at 50. In order to form the apparatus 50 of the present invention, a lockset door knob 52 is installed through the hole 32 in the door 26. The lockset 52 may be, for example, a Model LS02G32D, manufactured by LSDA and available from IDN/H. Hoffman Company of Indianapolis, Ind. Interacting with the lockset 52 when the door 26 is closed is a fail secure electric strike 54 mounted into the cutout 36 formed in the right side panels 16 and 18 of the installation mock-up frame 10. The electric strike 54 may be, for example, a Model AR7140-310-629-00 N.F.S., manufactured by Adams Rite MFG, Company and available from Security Lock Distributors of Needham Heights, Mass. The electric strike 54 may be locked or unlocked electronically, and when in the locked position, the electric strike 54 prevents the door 26 from being opened by blocking the path of the lockset 52 when attempting to open the door 26.

Also included in the apparatus 50 is a magnetic lock 56 which has a first portion mounted to the rear side of the door 26 (through hole 34) and a second portion mounted adjacent thereto on the top cross brace 22. The electromagnetic lock 56 may be, for example, a Micro Mag 8375, manufactured by Rutherford Controls and available from Security Lock Distributors of Needham Heights, Mass. The electromagnetic lock 56 is also electronically controlled and, when energized, creates a strong magnetic field which couples its two halves tightly together, thereby preventing the door 26 from being opened, regardless of the state of the electric strike 54.

The apparatus 50 further provides for monitoring of the open and closed status of the door 26 by means of two roller switches 58 and 60. Switch 58 is preferably a normally open, closed loop, door contact roller switch such as, for example, a Model 3005 manufactured by Sentrol Inc. and available from Security Equipment Supply of Indianapolis, Ind. Similarly, the switch 60 is a normally closed, open loop door contact roller switch such as, for example, a Model 3006 manufactured by Sentrol Inc. and available from Security Equipment Supply of Indianapolis, Ind. The switches 58 and 60 include plunger balls therein which are depressed when the door 26 is closed. Such depression causes the switch 58 to close and the switch 60 to open. It will be appreciated by those having ordinary skill in the art that the apparatus 50 therefore includes a mock-up of a door and door frame and has preinstalled therein a variety of electronic security and electronic access control devices commonly used with real-world doors.

The apparatus 50 also includes a first remote plate 62 mounted to the installation mock-up frame 10. Remote plate 62 is a typical electronic cover plate which might commonly be mounted to a wall, and houses a key switch 64 therein. The key switch 64 is an electrical single-pole, single-throw switch which may be operated by inserting a key therein and rotating the key 90 degrees in order to open or close the switch. The key is removeable in both positions. Key switch 64 may be, for example, a Model FOSW2 KA228 manufactured by Fort Lock and available from IDN/H. Hoffman Company of Indianapolis, Ind. Also mounted to the first remote plate 62 is a green light-emitting diode (LED) 66 and a red LED 68. A remote plate 62 having green and red LEDs 66 and 68 premounted therein, as well as a predrilled hole for the key switch 64 is available as Model RP-4, manufactured by Alarm Controls Corporation and available from Security Equipment Supply of Indianapolis, Ind.

A second remote plate 70 is also mounted to the installation mock-up frame 10 and includes a first shadow switch 72 and a second shadow switch 74 mounted therein. Shadow switch 72 is a latching switch which may be normally open or normally closed, while shadow switch 74 is a momentary switch, which may also be normally open or normally closed. Both shadow switches 72 and 74 may be, for example, Model FA-200 single-pole, double-throw switches (which can be converted to latching or momentary), manufactured by Alarm Controls Corporation and available from Security Equipment Supply of Indianapolis, Ind. The second remote plate 70 may be, for example, a Model RP-45 (which has two predrilled holes for mounting the shadow switches 72 and 74 therein) manufactured by Alarm Controls Corporation and available from Security Equipment Supply of Indianapolis, Ind.

The apparatus 50 further includes a passive infrared motion detector 76 mounted to the backplate 12 of the installation mock-up assembly 10. The motion detector 76 is operative to create an electrical output signal upon sensing movement in the space surrounding the motion detector 76. The motion detector 76 may be, for example, a Model DA-5 manufactured by Visonic and available from ADI of Indianapolis, Ind.

On the lower portion of the installation mock-up frame 10, the apparatus 50 includes a double-pole, double-throw relay module 78. The relay 78 may be, for example, a Model RB5 Double Form (C) relay manufactured by Altronix Inc. and available from ADI of Indianapolis, Ind. Also mounted to the bottom portion of the installation mock-up frame 10 is an alarm sounder 80, such as a Sonalert PA-100 manufactured by MG Corporation and available from Security Equipment Supply of Indianapolis, Ind. The alarm 80 is operative to create an audible noise upon being electrically energized. Also mounted to the lower portion of the installation mock-up frame 10 is a one amp 12-volt DC power supply 82 which is operative to convert from a 110-volt alternating current line signal to a 12-volt DC signal. The power supply 82 may be, for example, a Model AL612-12C with transformer TP1620, manufactured by Altronix Corporation and available from ADI of Indianapolis, Ind. The power supply 82 includes a fuse 84.

From the above description, it will be appreciated by those having skill in the art that the apparatus 50 incorporates many devices commonly used in the fields of electronic security and electronic access control, as well as a working door mounted into the installation mock-up frame 10. With all of these features provided within the frame 10, a student using the apparatus 50 may practice the design, installation, operation, and troubleshooting of electronic circuits using these devices in a classroom laboratory setting. It is only necessary that the student determine which components need to be interconnected in what manner, and then establish the electrical interconnection between the devices in order to create a mock-up of an electronic security or electronic access control circuit. Because it will be necessary to open and close the door 26 in order to verify the operation of many such circuits, it is imperative that the electrical interconnections established by the student do not lie across the door 26, thereby preventing its opening or risking interruption of such electrical interconnections due to interference between the opening door 26 and the wiring. The apparatus 50 therefore includes an upper terminal strip 86 and a lower terminal strip 88 mounted to the backplate 12 of the installation mock-up frame 10.

Figure 3:
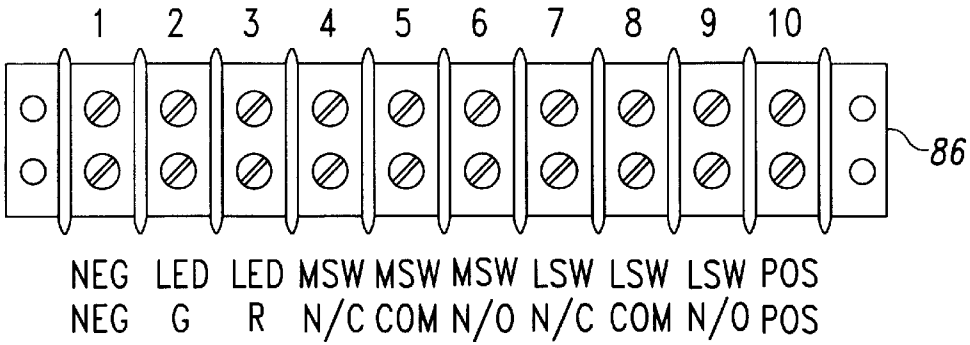
FIG. 3 is a top plan view of a top terminal block used in the apparatus of FIG. 2.
Figure 5:
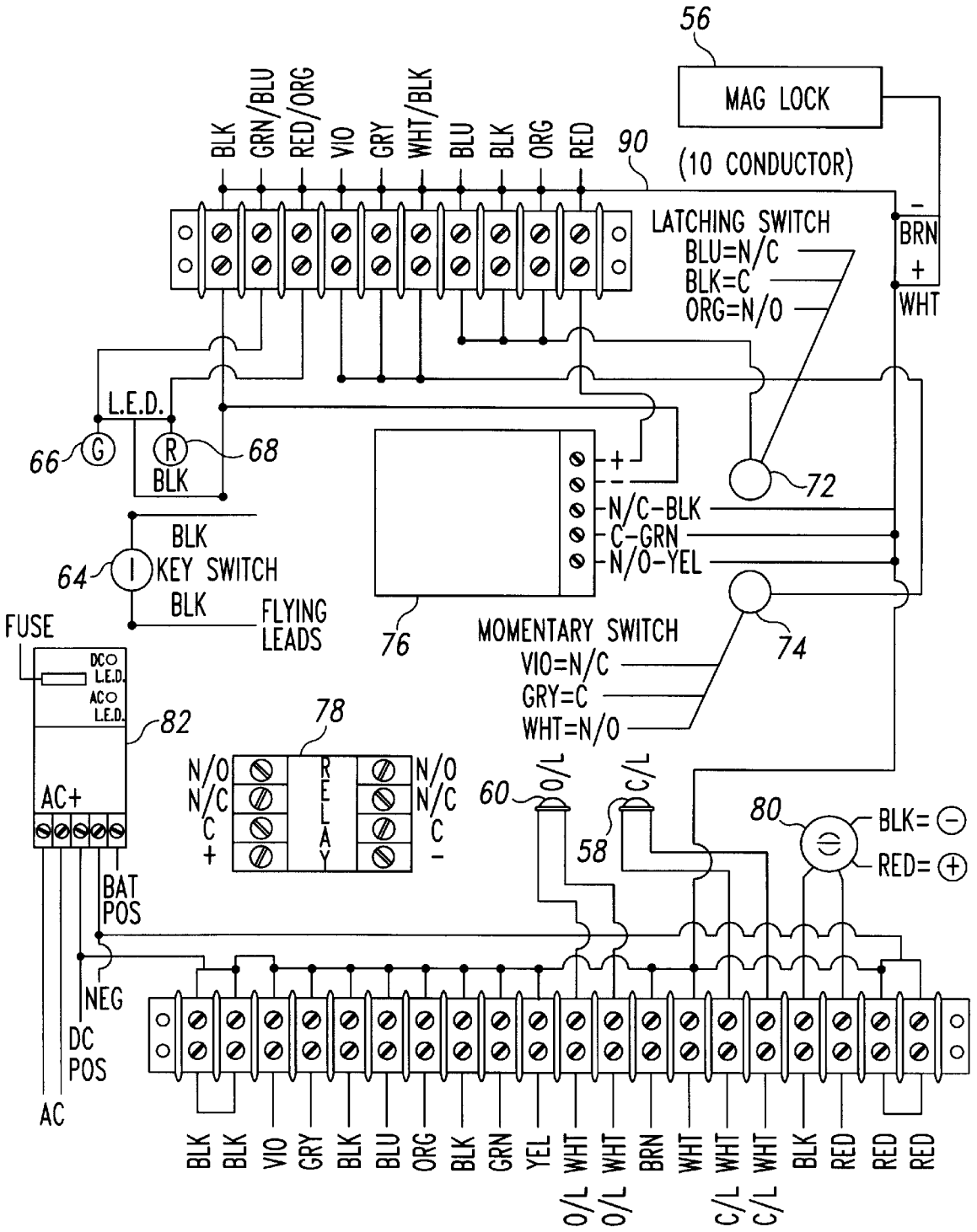
FIG. 5 is an electronic schematic wiring diagram of the apparatus of FIG. 2.

With reference to FIG. 3, it can be seen that the top terminal block 86 comprises a ten-position terminal block in the illustrated embodiment. One side of the terminal block 86 (such as the bottom row of terminals) is coupled to the negative power supply, the green LED 66, the red LED 68, the momentary switch 74 (three leads), the latching switch 72 (three leads), and the positive power supply. The other side of the terminal block 86 (such as the top row of terminals) is coupled to a ten-conductor wire 90 (see FIG. 5) which couples the top terminal block 86 to the bottom terminal block 88. The ten-conductor wire 90 is routed through the installation mock-up frame 10 behind the door 26, thereby allowing interconnection between the top terminal block 86 and the bottom terminal block 88 without interference from the door 26. FIG. 5 presents an electrical schematic wiring diagram of the entire apparatus 50. It will be appreciated by those having ordinary skill in the art that the two leads controlling the magnetic lock 56 are routed with the ten-wire conductor 90 to the bottom terminal block 88.

Figure 4:
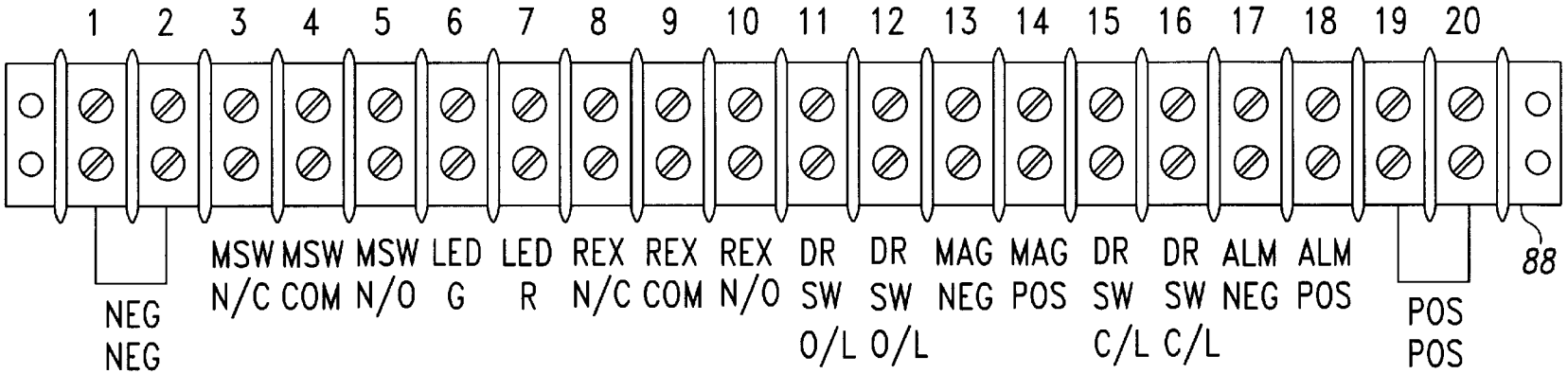
FIG. 4 is a top plan view of a bottom terminal block used in the apparatus of FIG.2.

As shown in FIG. 4, the bottom terminal block 88 is a 20-position terminal block in the illustrated embodiment. The top half of the terminal block 88 is coupled (via its bottom half terminals) to the devices at the top of the apparatus 50 which are carried by the ten-wire conductor 90 or by the wires routed therewith. The bottom terminal block 88 is also coupled to the devices mounted to the lower portion of the installation mock-up frame 10. In the illustrated embodiment, the bottom terminal block 88 includes connections to the negative power supply (two positions), the momentary switch 74 (three positions), the green LED 66, the red LED 68, the motion detector 76 (three positions), the open-loop door switch 60 (two positions), the magnetic lock 54 (two positions), the closed-loop door switch 58 (two positions), the alarm 80 (two positions), and the positive power supply (two positions). The key switch 64 and the electric strike plate 54 are mounted with flying leads (i.e., no connection to either terminal block), thus simulating real-world device leads which must be connected to. However, all of the leads of the devices in the apparatus 50 could be connected to the terminal blocks if terminal blocks having a sufficient number of positions were used. The present invention comprehends this alternative.

During use by the student, the bottom terminal block 88 has no connections made to one side thereof (preferably the lower side). These lower side terminals on the bottom terminal block 88 therefore comprise the area where most of the interconnections between the various devices mounted to the installation mock-up frame 10 will occur. For example, if the student desires to couple the open loop door switch 60 between the green LED and the positive power supply, it is only necessary to couple a wire between positions 19 and 12 and between positions 11 and 6 on the bottom terminal block 88. It will be appreciated by those having ordinary skill in the art that this enables connection between the door contact switch 60 which is located below the door 26, and the green LED 66, which is located above the door 26, without having to run a wire connection across the door 26. This is an important benefit of the apparatus 50 because it ensures that no interconnect wires at placed in a position where they would interfere with operation of the door 26. It will be further appreciated by those having ordinary skill in the art that the connection between the bottom terminal block 88 and the top terminal block 86 also supplies power from the power supply 82 to the devices coupled to the top terminal block 86.

It will be appreciated by those having ordinary skill in the art that the apparatus 50 incorporates most of the electronic and electromechanical devices which are normally used in the fields of electronic security and electronic access control. Furthermore, the apparatus 50 includes a working mock-up of an actual door, with a working lockset, electric strike, magnetic lock, and door contact roller switches mounted thereto. The apparatus 50 is therefore particularly well suited for providing instruction to students and enabling them to connect, test, and troubleshoot electronic circuits utilizing these devices right at the laboratory bench without requiring travel to a jobsite in the field. Furthermore, connection of most of the devices to the bottom terminal block 88 facilitates interconnection without obstructing the path of the door 26, while provision of flying leads on the items 54 and 64 without connection thereto to the terminal blocks additionally simulates real-world connections which must be made in the field.

Figure 6:
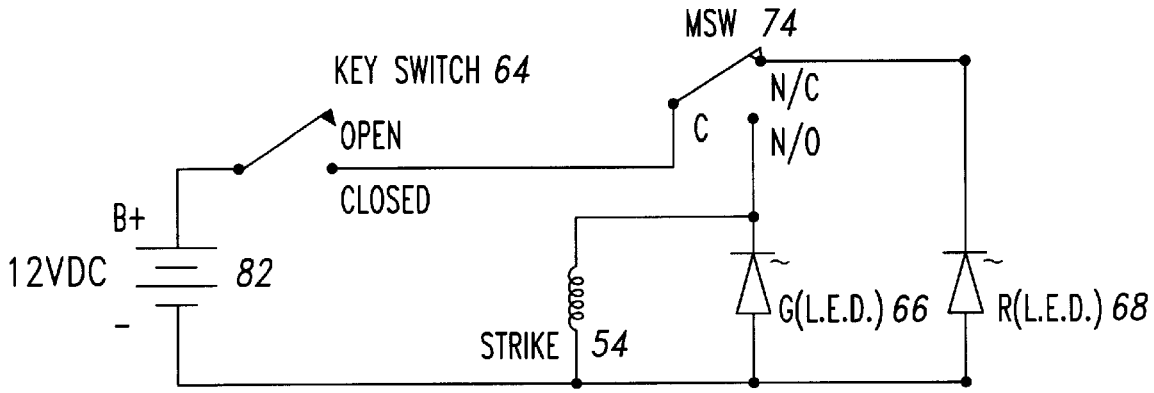
FIGS. 6–11 are electronic schematic circuit diagrams of sample electronic security and electronic access control circuits that may be constructed using the apparatus of FIG. 2.

The following is an example of instruction which may be given to students utilizing the apparatus 50 in order to connect and test the electronic circuits illustrated schematically in FIGS. 6–11. The sequence is divided into six lessons as follows:

Lesson 1: Electric Strike (FIG. 6)

Connect strike with N/O Momentary Switch (MSW). Push MSW button to release strike and make green LED show door is unlocked. Make red LED stay on at all times, except when the key has priority over the MSW. Connect Key Switch to demonstrate Emergency Key Override to prevent MSW from ever unlocking door. Note: When key switch has been opened, no lights will appear.

Note: Remove all test leads.

Six test leads required

Step 1: Clip 1st test lead to one side of strike, then to Negative (#1) on top terminal block.

Step 2: Clip 2nd test lead to positive side of strike, then to N/O of MSW (#6) on top terminal block.

Step 3: Clip 3rd test lead from Common of MSW (#5) on top terminal block, then to Key Switch flying lead #1.

Step 4: Clip 4th test lead from Green LED (#2) on top terminal block, then to positive side of strike.

Step 5: Clip 5th test lead from Red LED (#3) on top terminal block, then to other flying lead of Key Switch #2.

Step 6: Clip 6th test lead from flying lead #2of Key Switch to Positive (#10) on top terminal block.

Step 7: Meter voltage throughout circuit, have partner open and close switches.

Figure 7:
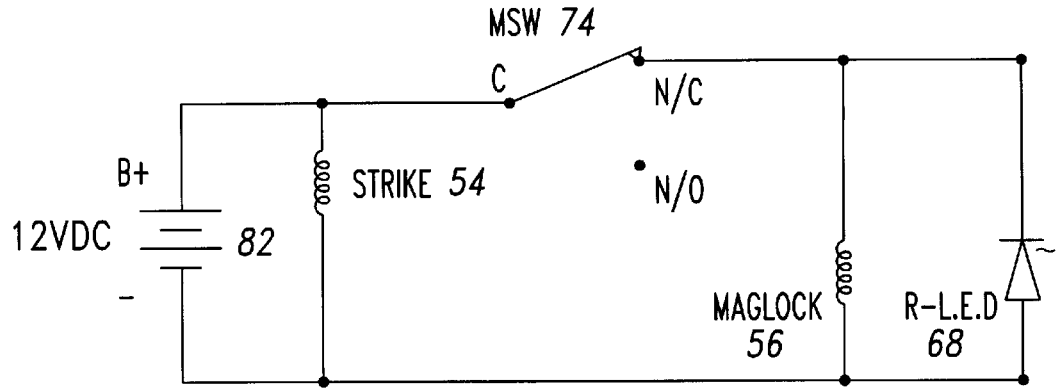

Lesson 2: Magnetic Lock (FIG. 7)

Unlock magnetic lock with MSW and show red LED to indicate door is locked. Red LED will go out when door is unlocked.

NOTE: Remove all test leads, except leave strike energized from top terminal. Verify strike is energized.

Four test leads required.

Step 1: Clip 1st test lead from negative of magnetic lock on bottom terminal block (#13), then to Negative on bottom terminal block (#1–#2).

Step 2: Clip 2nd test from positive of magnetic lock on bottom terminal block (#14), then to N/C of MSW on bottom of terminal block (#3).

Step 3: Clip 3rd test lead from common of MSW on bottom terminal block (#4), then to Positive on bottom terminal block (#19–#20). Push MSW to verify magnetic lock is released.

Step 4: Clip 4th test lead from red LED on bottom terminal block (#7) to N/C of MSW (#3) on bottom terminal block. Push MSW to verify red LED goes out when magnetic lock is released.

Figure 8:
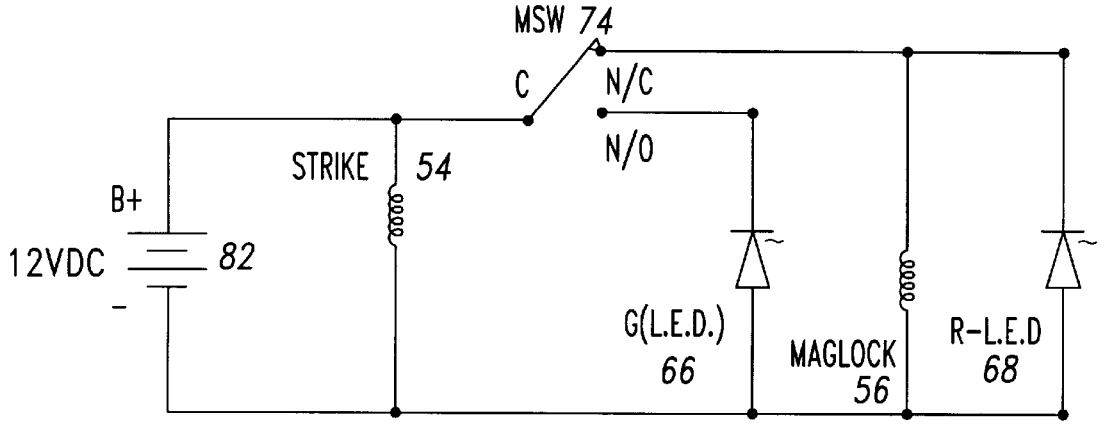

Lesson 3: Magnetic Lock (FIG. 8)

Unlock magnetic lock with MSW. Make red LED show door is locked. Push MSW and red LED will go out to indicate door is unlocked. Connect green LED to show door is unlocked. The red and green LED's will operate with the MSW.

NOTE: Leave all leads connected as in Lesson 2.

One additional test lead required.

Step 5: Clip 5th test lead from green LED on bottom terminal block (#6), then to N/O of MSW (#5) on bottom terminal block. Verify green LED is on when magnetic lock is released and red LED shows door is locked.

Figure 9:
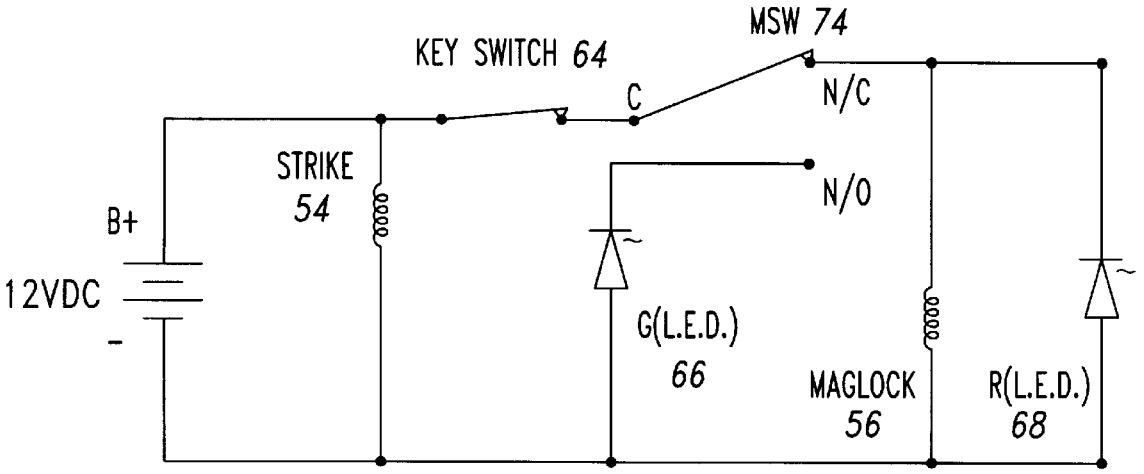

Lesson 4: Magnetic Lock/Override-Unlock (FIG. 9)

Unlock magnetic lock with MSW and make sure the red LED show door is locked, and green LED show door is unlocked. Connect key switch to demonstrate an emergency override unlock switch.

Example: Fire department entry or authority having jurisdiction requiring access.

NOTE: Leave all leads connected as in Lesson 3.

One additional test lead required.

Step 6: Remove test lead from common of MSW on bottom terminal block (#4), then reconnect to flying lead #1 of key switch.

Step 7: Clip 6th test lead from flying lead #2 of key switch to common of MSW on bottom terminal block (#4).

Figure 10:
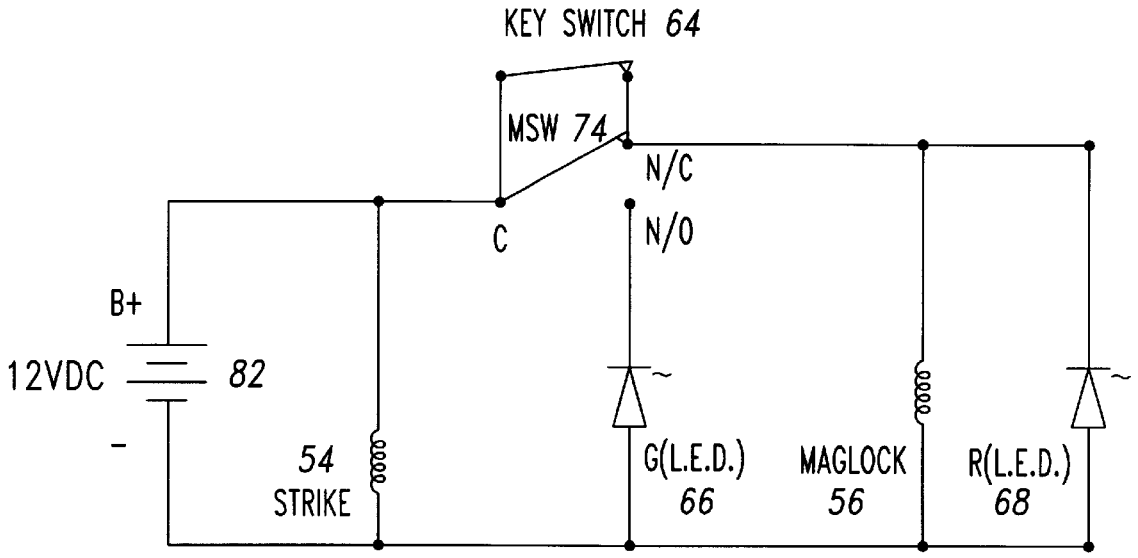

Lesson 5: Magnetic Lock/Override-Shunt Lock (FIG. 10)

Unlock magnetic lock with MSW and make sure the red LED show door is locked, and green LED show door is unlocked. Connect key switch as a shunt switch to demonstrate an emergency override lock shunt switch. Note: The magnetic lock should always be locked and the MSW will not unlock the door when key switch is operated as a shunt.

NOTE: Leave all leads connected as in Lesson 4.

One additional test lead required.

Step 8: Remove test lead from MSW common (#4) on bottom terminal block.

Step 9: Remove test lead from Positive (#19–#20) on bottom terminal block.

Step 10: Clip test lead from Positive (#19–#20), then to common of MSW (#4) on bottom terminal block. Verify magnetic lock released when pressing MSW and red LED shows locked and green LED shows unlocked.

Step 11: Reconnect key switch flying lead #1 to common of MSW (#5) on top terminal block.

Step 12: Reconnect key switch flying lead #2 to N/C of MSW (#4) on top terminal block. Verify that the door is locked with the key switch at 12:00 position and the MSW operates in the circuit. Turn key to the 3:00 position and verify the door is locked and the MSW will not operate, it has not been overridden by key switch (SHUNT).

Figure 11:
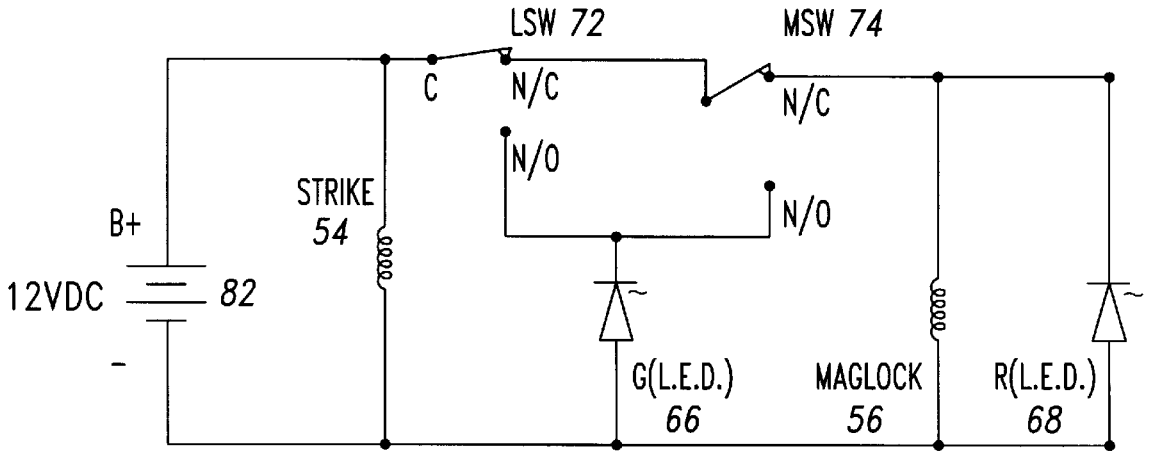

Lesson 6: Magnetic Lock/LSW Override (FIG. 11)

Power strike from top terminal to unlock strike for preceding magnetic lock lessons. Unlock magnetic lock with MSW and make sure red LED shows door is locked. Make sure green LED shows door is unlocked. Connect latching switch to demonstrate emergency override of magnetic lock.

NOTE: Remove key switch from circuit at top terminals #4 and #5.

Step 13: Remove test leads from flying leads of key switch at both ends.

Step 14: Clip test lead from common of MSW (#4) and reconnect to common of LSW (#8) on top terminal block.

Step 15: Clip test lead from N/C of LSW (#7) on top terminal block, then to common of MSW (#5) on top terminal block. Verify door is locked by magnetic lock and released by MSW.

Step 16: Clip test lead from N/O of LSW (#9) on top terminal block, then to N/O of MSW (#6) on top terminal block.

Note: LSW takes priority over MSW.

As can be clearly seen with reference to the above sample lessons, the apparatus 50 of the present invention greatly facilitates the provision of instruction in electronic security and electronic access control in a laboratory setting. The apparatus 50 may be used to provide instruction in electrical circuit theory as well as practical design, installation, and troubleshooting of electronic security and electronic access control systems. All of the devices necessary to construct such circuits are mounted in close physical proximity to each other and may be used in conjunction with the working model of a hinged door. Furthermore, most or all of the devices are connected to a system of terminal blocks which greatly facilitates interconnection of the devices into an electronic circuit. Finally, the apparatus 50 includes an integral power supply for providing power to the electronic circuit thus assembled.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. An apparatus for facilitating instruction of electronic security and electronic access control, comprising:

an installation mock-up frame having a cavity therein;

a door hingedly attached to the installation mock-up frame, such that the door has an open position and a closed position in which access to the cavity is prevented by the door;

a lockset installed into the door;

an electric strike installed into the installation mock-up frame and positioned so as to interact with the lockset;

a magnetic lock having first and second halves, the first half being coupled to the installation mock-up frame within the cavity and the second half being coupled to the door, wherein energization of the magnetic lock prevents the first and second halves from being separated, thus preventing the door from being opened;

a roller switch coupled to the installation mock-up frame and operative to sense whether the door is open or closed;

a plurality of electronic access control devices mounted to the installation mock-up frame above the door;

a top terminal strip mounted to the installation mock-up frame above the door, wherein the plurality of electronic access control devices are electrically coupled to the top terminal strip;

a bottom terminal strip mounted to the installation mock-up frame below the door;

a power supply mounted to the installation mock-up frame and coupled to the bottom terminal strip; and a multiconductor wire coupling the top terminal strip to the bottom terminal strip, such that power is provided to the top terminal strip and such that the plurality of electronic access control devices are electrically coupled to the bottom terminal strip;

wherein the installation mock-up frame is sized to be placed upon a laboratory bench; and wherein the plurality of electronic access control devices may be interconnected using the bottom and top terminal strips without placing wires across the door, thereby ensuring an unobstructed pathway for moving the door between the closed position and the open position.

2. The apparatus of claim 1, wherein the apparatus has exterior dimensions less than three feet by three feet.

3. The apparatus of claim 2, wherein the apparatus has exterior dimensions of 15 inches by 22 inches.

4. The apparatus of claim 1, wherein the magnetic lock, electric strike and roller switch are electrically coupled to the bottom terminal strip.

5. The apparatus of claim 1, wherein the plurality of electronic access control devices comprise:

a first remote plate having a key switch, a green LED, and a red LED mounted thereon; and a second remote plate having a momentary switch and a latching switch mounted thereon.

6. The apparatus of claim 1, further comprising:

a relay mounted to the installation mock-up frame adjacent the bottom terminal strip in order to facilitate interconnection therebetween.

7. An apparatus for facilitating instruction of electronic security and electronic access control, comprising:

an installation mock-up frame having a cavity therein;

a door hingedly attached to the installation mock-up frame, such that the door has an open position and a closed position in which access to the cavity is prevented by the door;

a lockset installed into the door;

an electric strike installed into the installation mock-up frame and positioned so as to interact with the lockset;

a plurality of electronic access control devices mounted to the installation mock-up frame above the door;

a top terminal strip mounted to the installation mock-up frame above the door, wherein the plurality of electronic access control devices are electrically coupled to the top terminal strip;

a bottom terminal strip mounted to the installation mock-up frame below the door;

a power supply mounted to the installation mock-up frame and coupled to the bottom terminal strip; and a multiconductor wire coupling the top terminal strip to the bottom terminal strip, such that power is provided to the top terminal strip and such that the plurality of electronic access control devices are electrically coupled to the bottom terminal strip;

wherein the installation mock-up frame is sized to be placed upon a laboratory bench; and wherein the plurality of electronic access control devices may be interconnected using the bottom and top terminal strips without placing wires across the door, thereby ensuring an unobstructed pathway for moving the door between the closed position and the open position.

8. The apparatus of claim 7, further comprising:

a magnetic lock having first and second halves, the first half being coupled to the installation mock-up frame within the cavity and the second half being coupled to the door, wherein energization of the magnetic lock prevents the first and second halves from being separated, thus preventing the door from being opened; and a roller switch coupled to the installation mock-up frame and operative to sense whether the door is open or closed.

9. The apparatus of claim 7, wherein the apparatus has exterior dimensions less than three feet by three feet.

10. The apparatus of claim 9, wherein the apparatus has exterior dimensions of 15 inches by 22 inches.

11. The apparatus of claim 8, wherein the magnetic lock, electric strike and roller switch are electrically coupled to the bottom terminal strip.

12. The apparatus of claim 7, wherein the plurality of electronic access control devices comprise:

a first remote plate having a key switch, a green LED and a red LED mounted thereon; and a second remote plate having a momentary switch and a latching switch mounted thereon.

13. The apparatus of claim 7, further comprising:

a relay mounted on the installation mock-up frame adjacent the bottom terminal strip in order to facilitate interconnection therebetween.

14. An apparatus for facilitating instruction of electronic security and electronic access control, comprising:

an installation mock-up frame having a cavity therein;

a door hingedly attached to the installation mock-up frame, such that the door has an open position and a closed position in which access to the cavity is prevented by the door;

a lockset installed into the door;

an electric strike installed into the installation mock-up frame and positioned so as to interact with the lockset;

a plurality of electronic access control devices mounted to the installation mock-up frame above the door;

a top terminal strip mounted to the installation mock-up frame above the door, wherein the plurality of electronic access control devices are electrically coupled to the top terminal strip;

a bottom terminal strip mounted to the installation mock-up frame below the door;

a multiconductor wire coupling the top terminal strip to the bottom terminal strip, such that the plurality of electronic access control devices are electrically coupled to the bottom terminal strip;

wherein the installation mock-up frame is sized to be placed upon a laboratory bench; and wherein the plurality of electronic access control devices may be interconnected using the bottom and top terminal strips without placing wires across the door, thereby ensuring an unobstructed pathway for moving the door between the closed position and the open position.

15. The apparatus of claim 14 further comprising:

a magnetic lock having first and second halves, the first half being coupled to the installation mock-up frame within the cavity and the second half being coupled to the door, wherein energization of the magnetic lock prevents the first and second halves from being separated, thus preventing the door from being opened; and a roller switch coupled to the installation mock-up frame and operative to sense whether the door is open or closed.

16. The apparatus of claim 14, further comprising:

a power supply mounted to the installation mock-up frame and coupled to the bottom terminal strip, such that power is provided to the top terminal strip.

17. The apparatus of claim 14, wherein the apparatus has exterior dimensions less than three feet by three feet.

18. The apparatus of claim 17, wherein the apparatus has exterior dimensions of 15 inches by 22 inches.

19. The apparatus of claim 15, wherein the magnetic lock, electric strike and roller switch are electrically coupled to the bottom terminal strip.

20. The apparatus of claim 14, wherein the plurality of electronic access control devices comprise:

a first remote plate having a key switch, a green LED and a red LED mounted thereon; and a second remote plate having a momentary switch and a latching switch mounted thereon.

* * * * *

CERTIFICATE OF CORRECTION

PATENT NO : 5,828,303
DATED : October 27, 1998
INVENTOR(S): Harold J. Williams

It is certified that error appears in the above-identified patent and that said Letters Patent are hereby corrected as shown below:

In column 1, line 4, please change "TEE" to --the--.
In column 4, line 1, please change "light" to --right--.

Signed and Sealed this

Fourteenth Day of December, 1999

*Attest:*

*Attesting Officer*

Q. TODD DICKINSON

*Acting Commissioner of Patents and Trademarks*